US009006553B2

(12) United States Patent
Mori

(10) Patent No.: US 9,006,553 B2
(45) Date of Patent: Apr. 14, 2015

(54) ROD-SHAPED ELECTRONIC PERCUSSION INSTRUMENT

(71) Applicant: Roland Corporation, Shizuoka (JP)

(72) Inventor: Yoshiaki Mori, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 14/088,449

(22) Filed: Nov. 25, 2013

(65) Prior Publication Data

US 2014/0165822 A1 Jun. 19, 2014

(30) Foreign Application Priority Data

Dec. 18, 2012 (JP) ..... 2012-276138

(51) Int. Cl.
*G10H 3/12* (2006.01)
*G10H 1/32* (2006.01)
*G10H 3/14* (2006.01)

(52) U.S. Cl.
CPC . *G10H 3/12* (2013.01); *G10H 1/32* (2013.01); *G10H 3/146* (2013.01); *G10H 2230/285* (2013.01)

(58) Field of Classification Search
USPC ..... 84/600–602, 723, 730, 743
See application file for complete search history.

(56) References Cited

U.S. PATENT DOCUMENTS

| | | | | | |
|---|---|---|---|---|---|
| 4,279,188 | A * | 7/1981 | Scott | 84/723 |
| 4,648,302 | A * | 3/1987 | Bozzio | 84/730 |
| 4,669,349 | A * | 6/1987 | Hyakutake | 84/730 |
| 4,679,479 | A * | 7/1987 | Koyamato | 84/743 |
| 4,700,602 | A * | 10/1987 | Bozzio | 84/732 |
| 4,924,741 | A * | 5/1990 | Vollenweider | 84/730 |
| 5,063,821 | A * | 11/1991 | Battle | 84/723 |
| 5,438,529 | A * | 8/1995 | Rosenberg et al. | 708/131 |
| 5,602,354 | A * | 2/1997 | Martin | 84/410 |
| RE36,387 | E * | 11/1999 | Rosenberg et al. | 702/139 |
| 2014/0165822 | A1 * | 6/2014 | Mori | 84/738 |

FOREIGN PATENT DOCUMENTS

| | | |
|---|---|---|
| JP | 55-099585 | 7/1980 |
| JP | 09-034447 | 2/1997 |

* cited by examiner

*Primary Examiner* — David Warren
(74) *Attorney, Agent, or Firm* — Jianq Chyun IP Office

(57) ABSTRACT

A rod-shaped electronic percussion instrument is provided. A rod-shaped percussion instrument, which has a striking surface made of an elastic material in a substantially rectangular shape when viewed from above, is characterized in including: a plate-shaped member, which is made of a hard material in a substantially rectangular shape and is elastically supported by a position facing a bottom surface side of the striking surface; and two sensors, which are disposed on a surface side of the plate-shaped member and detect a vibration due to striking on the striking surface, wherein the two sensors are connected to electrically combine detection signals detected by the sensors and output the same.

19 Claims, 7 Drawing Sheets

ROD-SHAPED ELECTRONIC PERCUSSION INSTRUMENT

CROSS-REFERENCE TO RELATED APPLICATIONS

This application claims the priority benefit of Japan application serial no. 2012-276138, filed on Dec. 18, 2012. The entirety of the above-mentioned patent application is hereby incorporated by reference herein and made a part of this specification.

BACKGROUND OF THE INVENTION

1. Field of the Invention

The present invention relates to a rod-shaped electronic percussion instrument. In particular, the present invention relates to a rod-shaped electronic percussion instrument that has detection sensitivity with improved uniformity for detecting striking on a struck position.

2. Description of Related Art

When a striking surface installed on an electronic percussion instrument, e.g. electronic drum, is struck with a stick, etc., generally the electronic percussion instrument detects a vibration due to the striking by a vibration sensor, e.g. piezoelectric element, and utilizes a detection signal thereof to trigger a generation of a musical sound. Such an electronic percussion instrument is required to uniformly detect striking of the same strength regardless of the positions of the striking surface that are struck.

To meet this requirement, Patent Literature 1 proposes disposing piezoelectric elements (piezoelectric films) respectively at the anti-node positions of each higher-harmonic-vibration of a circular vibration film (striking surface). Furthermore, Patent Literature 2 proposes disposing piezoelectric elements (vibration sensors) respectively at the anti-node positions of each vibration mode of a circular striking surface.

However, even in the situation of respectively disposing multiple piezoelectric elements at the anti-node positions of each higher-harmonic-vibration or each vibration mode, there is a problem that the detection sensitivity for one higher-order vibration (second-order vibration, for example) may be inferior to the detection sensitivity for other high-order vibrations.

PRIOR ART LITERATURE

Patent Literature

[Patent Literature 1] Japanese Utility Model Publication No. 55-99585

[Patent Literature 2] Japanese Patent Publication No. 9-34447

SUMMARY OF THE INVENTION

Considering the above, the present invention provides a rod-shaped electronic percussion instrument that has detection sensitivity with improved uniformity for detecting striking on a struck position.

A rod-shaped percussion instrument of the present invention has the following effects. A sidewall part is connected with a periphery of a striking surface that has a substantially rectangular shape when viewed from above. A plate-shaped member, which is made of a hard material in a substantially rectangular shape, is elastically supported by an inner circumference side of the sidewall part. Two sensors are disposed on a surface side of the plate-shaped member and detect a vibration due to striking on the striking surface. The sensors are connected to electrically combine detection signals respectively detected by the sensors and output the same. Accordingly, the striking on the striking surface can be sensed without an addition operation, by means of software, of an absolute value of the detection signals detected by the sensors. Consequently, the sensing process is simplified and can be achieved with lower costs.

In this way, the rod-shaped percussion instrument of the present invention further has the following effects. The two sensors are respectively disposed in a predetermined range located on two sides of a center line that extends in a transverse direction through a center of a longitudinal direction of the plate-shaped member. In particular, each of the sensors is disposed in the range between a first position and a second position, wherein the first position is apart from the center line of ½ of a distance from the center line to an end side of the plate-shaped member in the longitudinal direction, and the second position is apart from the center line of ¾ of the distance from the center line to the end side of the plate-shaped member in the longitudinal direction. By disposing the two sensors respectively in the aforementioned arrangement range, the two sensors, electrically connected to combine the detection signals respectively detected by the two sensors and output the same, thereby improve the uniformity of the detection sensitivity for detecting the striking on the struck position.

Moreover, the "substantially rectangular shape" mentioned here is not limited to the so-called rectangular shape and may include an arc shape that is approximately rectangular.

According to other aspect of the present invention, in addition to the aforementioned effects, the rod-shaped percussion instrument of the present invention further has the following effects. Each of the two sensors is disposed in a range between the first position and a third position, wherein the first position is apart from the center line of ½ of the distance from the center line to the end side of the plate-shaped member in the longitudinal direction, and the third position is apart from the center line of ⅔ of the distance from the center line to the end side of the plate-shaped member in the longitudinal direction. Thus, the uniformity of the detection sensitivity for detecting the striking on the struck position can be improved more preferably.

According to other aspect of the present invention, in addition to the aforementioned effects, the rod-shaped percussion instrument of the present invention further has the following effects. The two sensors are disposed symmetrically with the center line of the plate-shaped member as an axis of symmetry. Thus, when a center of the attachment is struck, a time difference between the respective sensors' detection of the striking can be eliminated and the sensing accuracy can be increased.

According to other aspect of the present invention, in addition to the aforementioned effects, the rod-shaped percussion instrument of the present invention further has the following effects. Long sides and short sides of the plate-shaped member are fitted in a concave portion formed on the inner circumference side of the sidewall part so that the plate-shaped member is elastically supported. Thus, when the striking surface is struck, the plate-shaped member vibrates in a state that the four sides thereof are simply supported. For the plate-shaped member that vibrates in the state that the four sides thereof are simply supported, a vibration frequency in the transverse direction is very high in comparison with a vibration frequency in the longitudinal direction, and amplitude at this moment is so small that it can be ignored. Therefore, for the plate-shaped member that vibrates in the state that the four sides thereof are simply supported, it is possible to consider only the vibration in the longitudinal direction when considering the arrangement of the sensors. Accordingly, by disposing the two sensors on such a plate-shaped member respectively in the predetermined range located on two sides of the center line that extends in the transverse direction through the center of the longitudinal direction of the plate-shaped member, the uniformity of the detection sensitivity for detecting the striking on the struck position can be improved.

DESCRIPTION OF THE EMBODIMENTS

Figure 1:
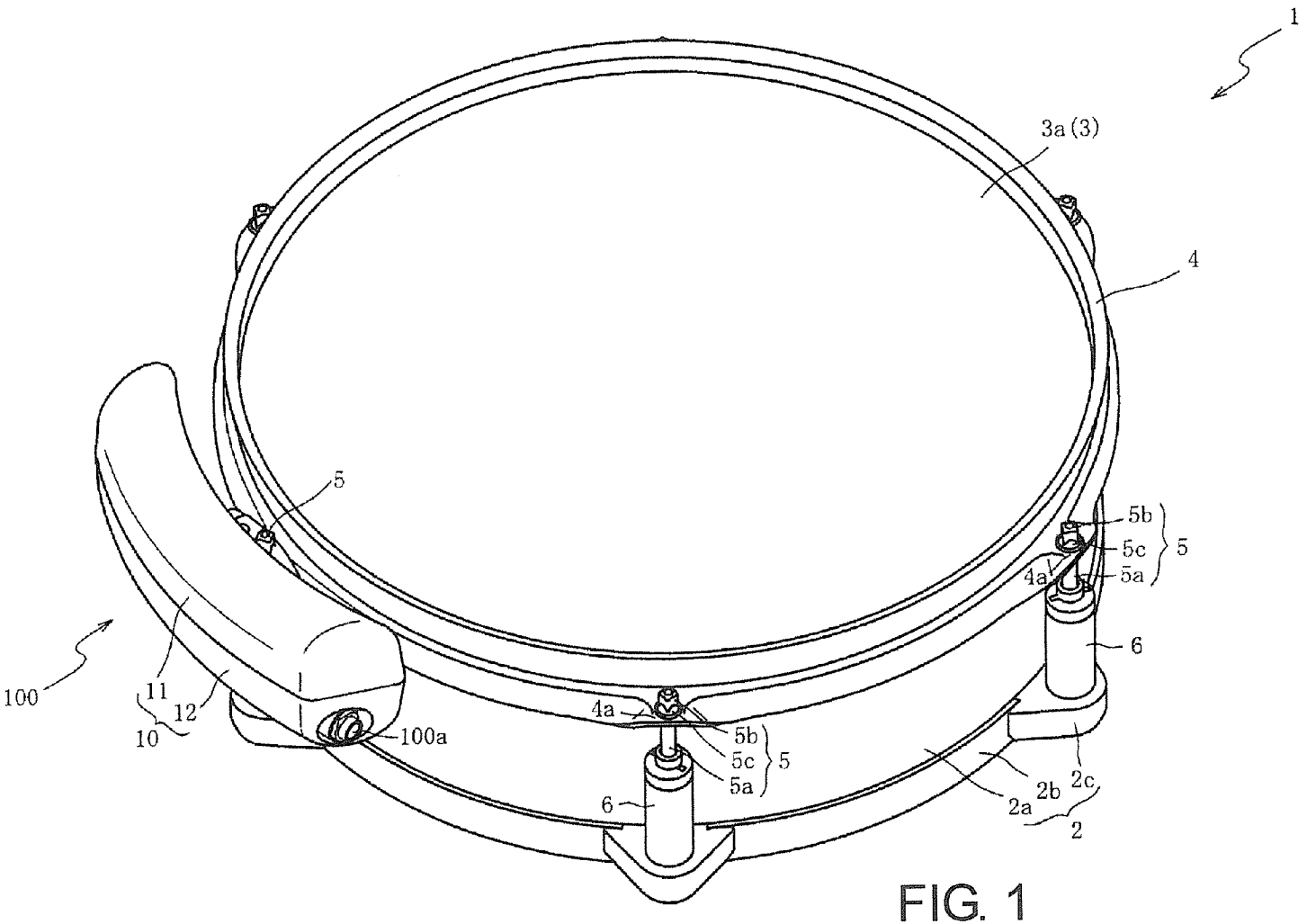
FIG. 1 is a schematic perspective view of a drum with an attachment installed thereon in an exemplary embodiment of the present invention.

Below preferable exemplary embodiments of the present invention are described in detail with reference to the affixed figures. First, referring to FIG. 1, a schematic structure of a drum 1 that has an attachment 100 installed thereon is described hereinafter according to an exemplary embodiment of a rod-shaped percussion instrument of the present invention. FIG. 1 is a schematic perspective view of the drum 1 with the attachment 100 installed thereon.

As shown in FIG. 1, the drum 1 is an electronic percussion instrument adapted to be struck by the player. The drum 1 mainly includes a body part 2, a head 3, a hoop 4, tension bolts 5, and lugs 6. The body part 2 has a cylindrical shape that is open at one side. The head 3 is stretched to be installed on the one side (the upper side of FIG. 1) of the body part 2. The hoop 4 presses a peripheral part of the head 3. The tension bolts 5 apply tension on the head 3 through the hoop 4. The lugs 6 are disposed on the body part 2 and the tension bolts 5 are screwed to the lugs 6.

The body part 2 is a member that serves as the body of the drum 1, and includes a shell 2*a*, a bottom part 2*b*, and extended parts 2*c*. The shell 2*a* has a cylindrical shape that is open at one side and the other side (the upper side and lower side of FIG. 1). The bottom part 2*b* covers the other side (the lower side of FIG. 1) of the shell 2*a*. The extended parts 2*c* are formed to extend outward from the bottom part 2*b* in a radial direction of the shell 2*a*. A plurality of the extended parts 2*c* (the number is 6 in this exemplary embodiment) are disposed with equal intervals along a circumferential direction of the shell 2*a*.

Figure 4A:
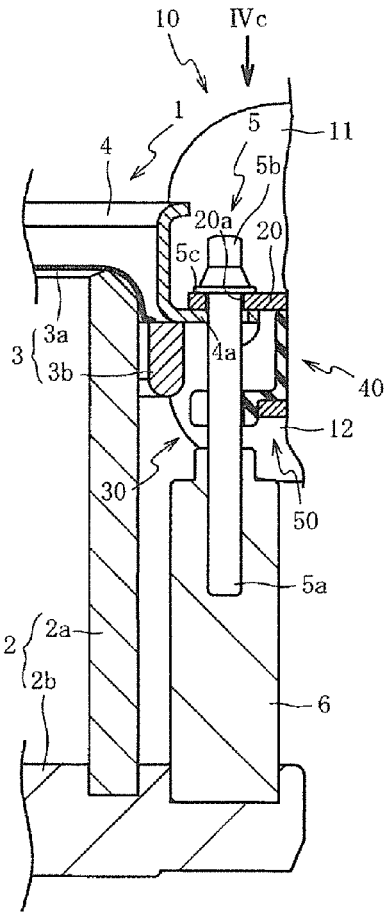
FIG. 4A is a partial cross-sectional view of a drum with an attachment installed thereon.

The head 3 includes a membrane-shaped striking surface part 3*a* and a frame part 3*b* (see FIG. 4A). The frame part 3*b* is fixed to an outer edge of the striking surface part 3*a*. The striking surface part 3*a* is a member adapted to be struck by the player. The frame part 3*b* is a member locked to the hoop 4 and is made of a metal material that has a predetermined stiffness. The frame part 3*b* has an inner diameter that is larger than an outer diameter of the shell 2*a*. When the striking surface part 3*a* is installed to cover the one side of the shell 2*a*, the frame part 3*b* is pressed toward the other side (the lower side of FIG. 1) of the shell 2*a* to apply tension to the striking surface part 3*a*. Nevertheless, it should be noted that the frame part 3*b* is not necessarily made of the metal material, and may also be made of a resin material, etc., that has the predetermined stiffness.

The hoop 4 is an annular member, which is adapted to press the frame part 3*b* of the head 3, so as to apply tension to the striking surface part 3*a*. An inner diameter of the hoop 4 is larger than the outer diameter of the shell 2*a* and smaller than an outer diameter of the frame part 3*b*. Moreover, the hoop 4 includes flange parts 4*a* and through holes 4*b* (see FIG. 4B). The flange parts 4*a* extend outward in a radial direction of the hoop 4. The through holes 4*b* are formed to pass through the flange parts 4*a* respectively. A plurality of the flange parts 4*a* and the through holes 4*b* (the number is 6 respectively in this exemplary embodiment) are disposed with equal intervals along a circumferential direction of the hoop 4. The interval between two adjacent flange parts 4*a* in the circumferential direction is set to be equal to the interval between two adjacent extended parts 2*c* of the body part 2 in the circumferential direction.

The tension bolts 5 each include a male screw part 5*a*, a head part 5*b*, and an engagement part 5*c*. A male thread is formed on the male screw part 5*a*. The head part 5*b* is connected with the male screw part 5*a* at one side (the upper side of FIG. 1) in an axial direction of the male screw part 5*a*. The engagement part 5*c* extends in a flange shape at a connection portion between the male screw part 5*a* and the head part 5*b*.

An inner diameter of the through hole 4*b* of the hoop 4 is larger than an outer diameter of the male screw part 5*a* and smaller than an outer diameter of the engagement part 5*c*. Thus, by inserting the male screw part 5*a* into the through hole 4*b* from a top surface side of the flange part 4*a*, the engagement part 5*c* is locked to the top surface of the flange part 4*a*.

The lug 6 is a cylindrical member and has a female thread to which the male thread formed on the male screw part 5*a* of the tension bolt 5 is screwed. The lug 6 is installed upright on the extended part 2*c* at a position apart from an outer circumferential surface of the shell 2*a* of the body part 2. An interval between two adjacent lugs 6 in the circumferential direction is set to be equal to the interval between two adjacent through holes 4*b* of the hoop 4 in the circumferential direction (see FIG. 4B). In this exemplary embodiment, the lugs 6 are installed upright on the extended parts 2*c* respectively at positions apart from the outer circumferential surface of the shell 2*a*. However, the extended parts 2*c* may be omitted, and in that case, the lugs 6 may be fixed to the outer circumferential surface of the shell 2*a*.

In the drum 1, the engagement part 5*c* of the tension bolt 5 is locked to the flange part 4*a* of the hoop 4. In such a state, the male screw part 5*a* of the tension bolt 5 is screwed to the lug 6, and thereby the frame part 3*b* of the head 3 (see FIG. 4B) is pressed toward the other side of the body part 2 through the hoop 4. As a result, tension is applied to the striking surface part 3*a* of the head 3. The player may adjust the tightness of the tension bolt 5 with respect to the lug 6, so as to set the tension applied to the striking surface part 3*a* in accordance with the player's preference.

The attachment 100 is detachably installed on the drum 1. The attachment 100 is an electronic percussion instrument that is adapted to be struck by the player. The attachment 100 includes a main body part 10 having a rod shape that is curved into an arc. The main body part 10 serves as a primary body portion of the attachment 100. The main body part 10 includes an upper main body part 11 and a lower main body part 12. The upper main body part 11 constitutes an upper portion of the main body part 10, and the lower main body part 12 is connected to a bottom surface of the upper main body part 11 and constitutes the lower portion of the main body part 10.

The upper main body part 11 is a member adapted to be struck by the player and is made of an elastic material, such as rubber, etc. The upper main body part 11 is configured so that a vibration sensor 61 (see FIG. 5A) can be disposed therein. Details thereof will be explained later. When the attachment 100 (the upper main body part 11) is struck, the vibration sensor 61 is used to detect a vibration of the striking. In this exemplary embodiment, the upper main body part 11 is made of the rubber material; however, the upper main body part 11 may also be formed using other materials, such as an elastomer or a foaming agent. Moreover, in this exemplary embodiment, the lower main body part 12 is made of a resin material; however, the lower main body part 12 may also be formed using other materials, such as a thin iron plate or aluminum, etc.

The lower main body part 12 is made of the resin material. A jack 100*a* is installed at an end side of a longitudinal direction of the lower main body part 12. The jack 100*a* is electrically connected with the vibration sensor 61. In addition, the jack 100*a* and a sound source device (not shown) are electrically connected with each other via a connection cable (not shown). Accordingly, a detection signal of the vibration sensor 61, which is generated based on the striking on the attachment 100, is transmitted to the jack 100*a* and then transmitted to the sound source device via the connection cable. The sound source device generates musical tones based on the detection signal.

Figures 2A, 2B, 2C:
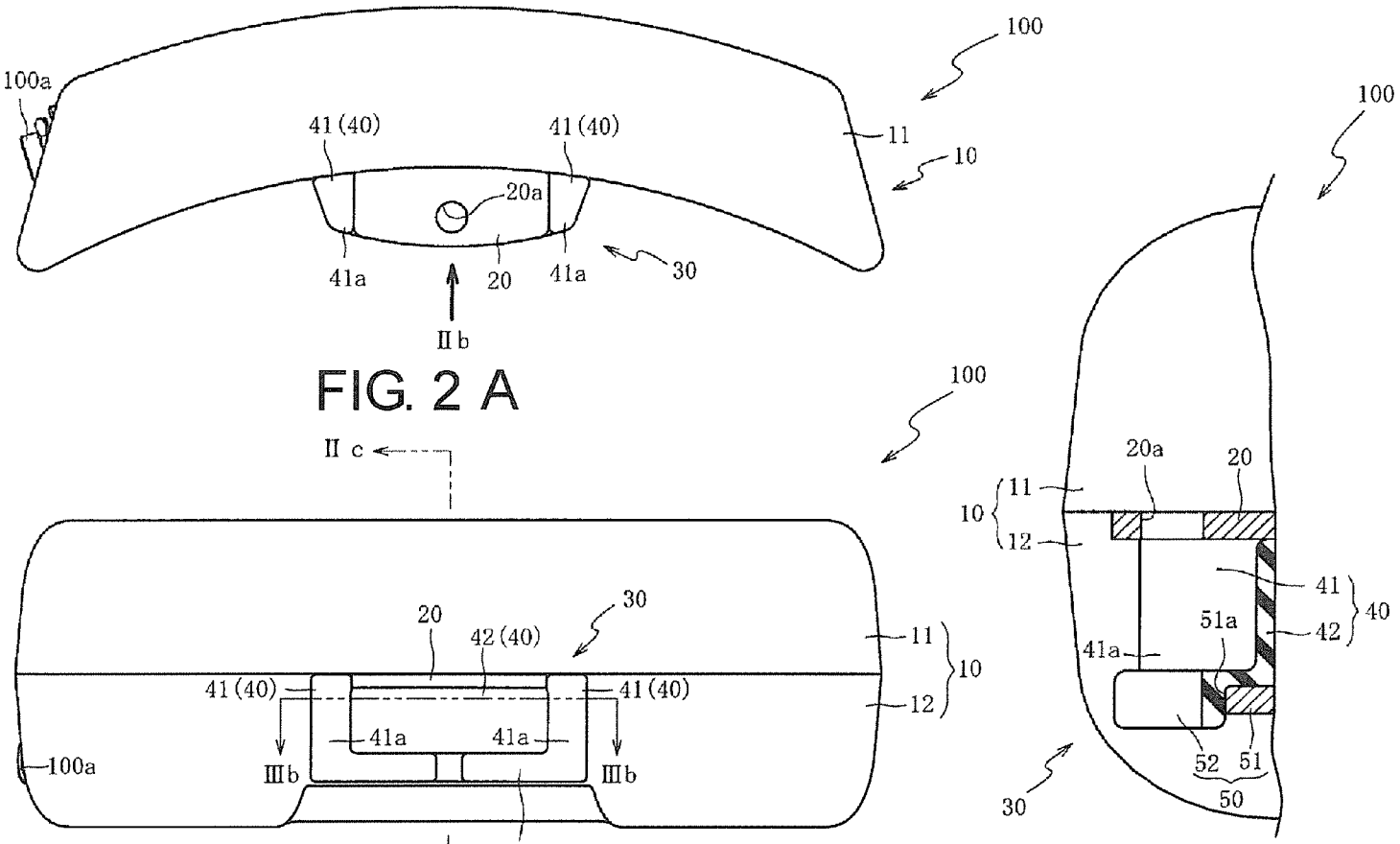
FIG. 2A is a schematic top view of the attachment.
FIG. 2B is a schematic side view of the attachment when viewed from the IIb direction of FIG. 2A.
FIG. 2C is a partially enlarged cross-sectional view of the attachment along the IIc-IIc line of FIG. 2B.
Figure 3A:
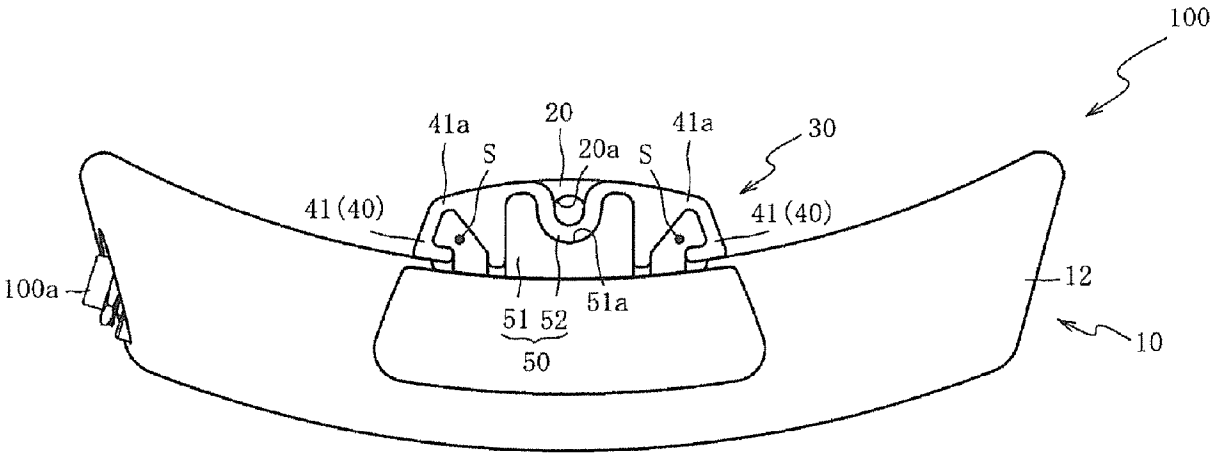
FIG. 3A is a schematic bottom view of the attachment.
Figure 3B:
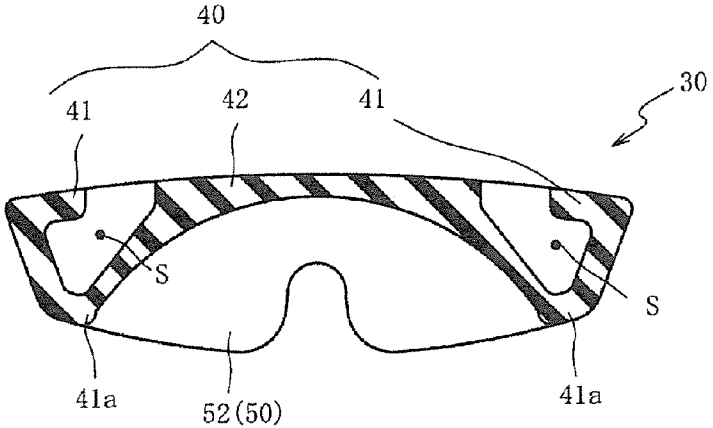
FIG. 3B is a partially enlarged cross-sectional view of the attachment along the line of FIG. 2B.

Next, the appearance and shape of the attachment 100 are explained in detail with reference to FIG. 2A to FIG. 3B. FIG. 2A is a schematic top view of the attachment 100. FIG. 2B is a schematic side view of the attachment 100 when viewed from the IIb direction of FIG. 2A. FIG. 2C is a partially enlarged cross-sectional view of the attachment 100 along the IIc-IIc line of FIG. 2B. FIG. 3A is a schematic bottom view of the attachment 100. FIG. 3B is a partially enlarged cross-sectional view of the attachment 100 along the IIIb-IIIb line of FIG. 2B. In order to simplify the illustration and facilitate the understanding of the embodiment, in FIG. 2C, a part of the main body part 10 is omitted. Moreover, in FIG. 3B, the main body part 10 is also omitted.

As shown in FIG. 2A to FIG. 2C and FIG. 3A to FIG. 3B, the attachment 100 mainly includes the main body part 10, a plate 20, and a restricting part 30. The plate 20 extends inward (the lower side of FIG. 2A) in a radial direction from an inner circumferential surface of the main body part 10 (the surface at the lower side of FIG. 2A). The restricting part 30 is disposed near the plate 20 and protrudes inward in the radial direction from the inner circumferential surface of the main body part 10.

Figure 4B:
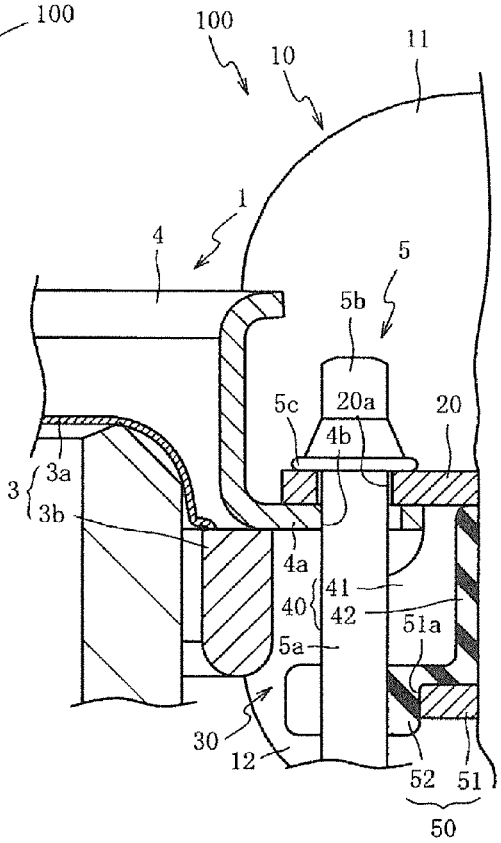
FIG. 4B is a partially enlarged cross-sectional view of the drum with the attachment installed thereon.

The plate 20 is a member tightened together with the flange part 4*a* of the hoop 4 by the tension bolt 5 (see FIG. 4B). Moreover, the plate 20 is made of a plate-shaped metal material. A locking hole 20*a* is formed in the plate 20. An inner diameter of the locking hole 20*a* is larger than an outer diameter of the male screw part 5*a* of the tension bolt 5 and smaller than an outer diameter of the engagement part 5*c*. By inserting the male screw part 5*a* of the tension bolt 5 into the locking hole 20*a*, the engagement part 5*c* is locked to the plate 20 (see FIG. 4B).

The restricting part 30 is a member that restricts displacement of the main body part 10 and the plate 20 relative to the drum 1 (see FIG. 1). The restricting part 30 includes a flange supporting part 40 and a bolt supporting part 50. The flange supporting part 40 supports the flange part 4*a* of the hoop 4 (see FIG. 4B), and the bolt supporting part 50 supports the male screw part 5*a* of the tension bolt 5 (see FIG. 4B).

The flange supporting part 40 is made of an elastic material, and includes a pair of protrusion parts 41 and a connection part 42. The protrusion parts 41 are disposed to protrude inward (the left side of FIG. 2C) in the radial direction from the inner circumferential surface of the main body part 10 (the surface at the left side of FIG. 2C). In addition, the protrusion parts 41 are separated by a predetermined interval in the circumferential direction of the main body part 10. The connection part 42 is connected between the pair of protrusion parts 41 and recessed outward (the right side of FIG. 2C) in the radial direction of the main body part 10.

The protrusion parts 41 support the flange part 4*a* of the hoop 4 (see FIG. 4C) and respectively include pressure contact parts 41*a*. The pressure contact part 41*a* is formed at a front end portion of the protrusion part 41 in a protrusion direction thereof (the downward direction of FIG. 3B). In addition, the pressure contact part 41*a* is pressure-contacted by the flange part 4*a*. A gap S is formed between the pressure contact part 41*a* and the main body part 10. Moreover, by recessing the connection part 42 outward in the radial direction of the main body part 10, the flange part 4*a* can be received in a space surrounded by the plate 20 and the pair of protrusion parts 41.

The bolt supporting part 50 includes a rigid part 51 and an elastic part 52. The rigid part 51 is disposed to protrude from the inner circumferential surface of the main body part 10 (the surface at the upper side of FIG. 3A). The elastic part 52 is disposed to cover a front end portion of the rigid part 51 in a protrusion direction thereof (the upward direction of FIG. 3A).

The rigid part 51 restricts the displacement of the main body part 10 and the plate 20 relative to the tension bolt 5 (see FIG. 4A). The rigid part 51 is made of a metal material that has a predetermined stiffness, and the rigid part 51 includes a recess part 51*a* that is recessed at the front end portion in the protrusion direction thereof. Moreover, a recess bottom surface of the recess part 51*a* has an arc shape and looks like a "U" when viewed from above.

The arc-shaped portion of the recess part 51*a* is formed to be concentric with the locking hole 20*a* of the plate 20. In addition, an inner diameter of the arc-shaped portion is larger than the outer diameter of the male screw part 5*a* of the tension bolt 5 (see FIG. 4A).

The rigid part 51 is formed integrally with the plate 20 using the same metal material as the plate 20. Moreover, the upper main body part 11 and the lower main body part 12 are fixed in a state that a portion connecting the rigid part 51 and the plate 20 is received inside the main body part 10. Accordingly, in comparison with the situation that the rigid part 51 and the plate 20 are formed separately, the number of the parts can be reduced. In addition, it is not required to align the positions of the recess part 51*a* of the rigid part 51 and the locking hole 20*a* of the plate 20, and therefore, the production efficiency of the attachment 100 can be improved.

The elastic part 52 touches the male screw part 5*a* of the tension bolt 5 (see FIG. 4A). The elastic part 52 is made of an elastic material that has lower stiffness than the rigid part 51. The elastic part 52 is recessed like a "U" when viewed from above and formed conformal with the shape of the recess part 51*a* of the rigid part 51. An arc-shaped portion of the elastic part 52 is formed to be concentric with the locking hole 20*a* of the plate 20. Furthermore, an inner diameter of the arc-shaped portion is smaller than the outer diameter of the male screw part 5*a* of the tension bolt 5.

The elastic part 52 is formed integrally with the flange supporting part 40 using the same elastic material as the flange supporting part 40. Thus, the number of the parts can be reduced. In addition, the gap S is formed between the pressure contact part 41*a* of the flange supporting part 40 and the main body part 10. With the gap S, the pressure contact part 41*a* can be elastically deformed easily. Therefore, even though the flange supporting part 40 and the elastic part 52 are made of the same elastic material, the pressure contact part 41*a* can be elastically deformed more easily than the elastic part 52.

Figure 4C:
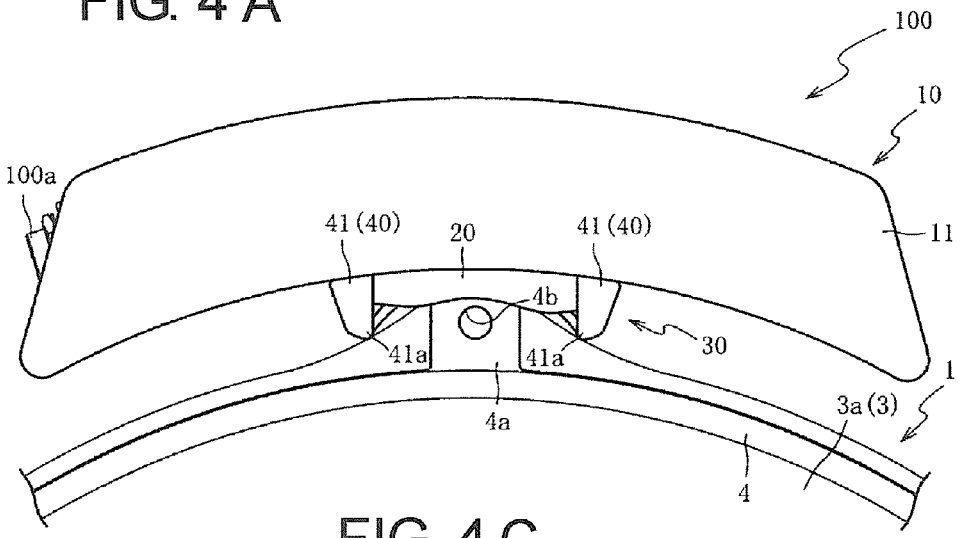
FIG. 4C is a schematic top view of the drum when viewed from the IVc direction indicated by the arrow of FIG. 4A.

Next, with reference to FIG. 4, an installation state of the attachment 100 on the drum 1 is explained hereinafter. FIG. 4A is a partial cross-sectional view of the drum 1 with the attachment 100 installed thereon. FIG. 4B is a partially enlarged cross-sectional view of the drum 1 with the attachment 100 installed thereon. FIG. 4C is a schematic top view of the drum 1 when viewed from the IVc direction of FIG. 4A. Moreover, FIG. 4A and FIG. 4B illustrate cross-sections along a plane that includes an axle center of the tension bolt 5, which tightens the attachment 100 together with the hoop 4, and an axle center of the hoop 4. FIG. 4B further enlarges a part of FIG. 4A. In order to simplify the illustration and make it easy to understand, in FIG. 4A and FIG. 4B, a part of the main body part 10 is omitted, and in FIG. 4C, a part of the plate 20 is omitted.

As illustrated in FIG. 4A to FIG. 4C, when the attachment 100 is installed on the drum 1, the plate 20 is placed on the top surface of the flange part 4*a* of the hoop 4. In such a state, the male screw part 5*a* of the tension bolt 5 is inserted into the locking hole 20*a* of the plate 20 and the through hole 4*b* of the hoop 4. Furthermore, the male screw part 5*a* is screwed into the lug 6. Meanwhile, with respect to the restricting part 30, the pressure contact part 41*a* of the flange supporting part 40 is in pressure contact with the flange part 4*a*. Moreover, the elastic part 52 of the bolt supporting part 50 touches the male screw part 5*a* of the tension bolt 5.

As the male screw part 5*a* is screwed into the lug 6, the engagement part 5*c* of the tension bolt 5 is locked to the plate 20. Besides, the engagement part 5*c* presses the frame part 3*b* of the head 3 toward the other side (FIG. 4A) of the shell 2*a* via the plate 20 and the hoop 4. Through adjustment of the tightness of the tension bolt 5 on the lug 6, the player can set the tension of the striking surface part 3*a* according to the player's preference. At the same time, the plate 20 is tightened together with the flange part 4*a* by the tension bolt 5, so as to install the attachment 100 on the drum 1.

Figure 5B:
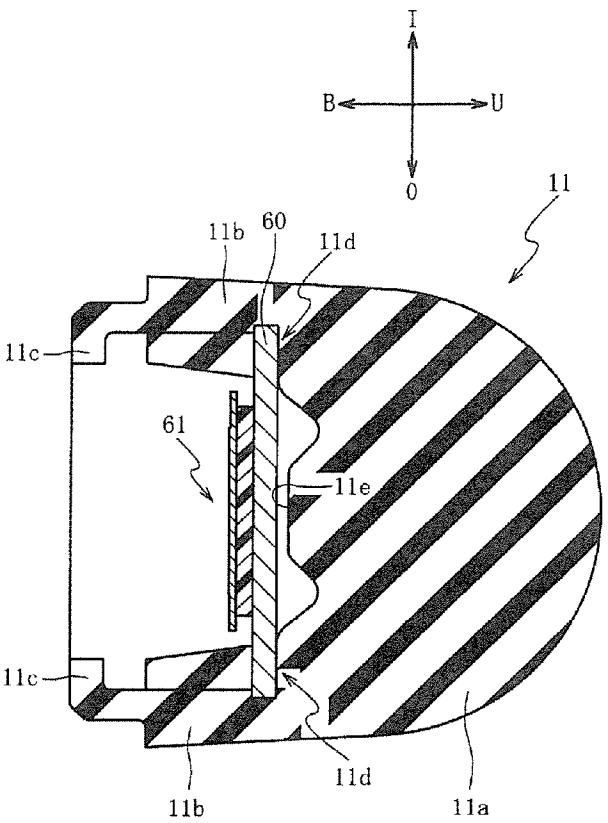
FIG. 5B is an enlarged cross-sectional view of the upper main body part along the Vb-Vb line of FIG. 5A.
Figure 5A:
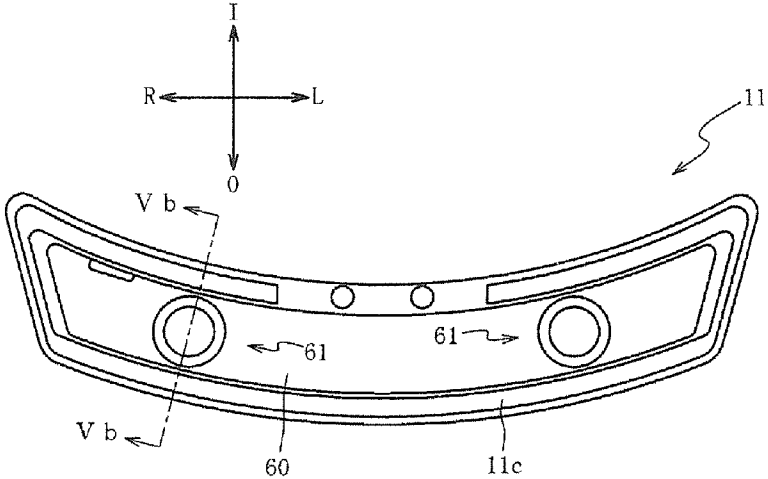
FIG. 5A is a schematic bottom view of an upper main body part with a sensor plate installed thereon when viewed from the lower side.
Figure 5C:
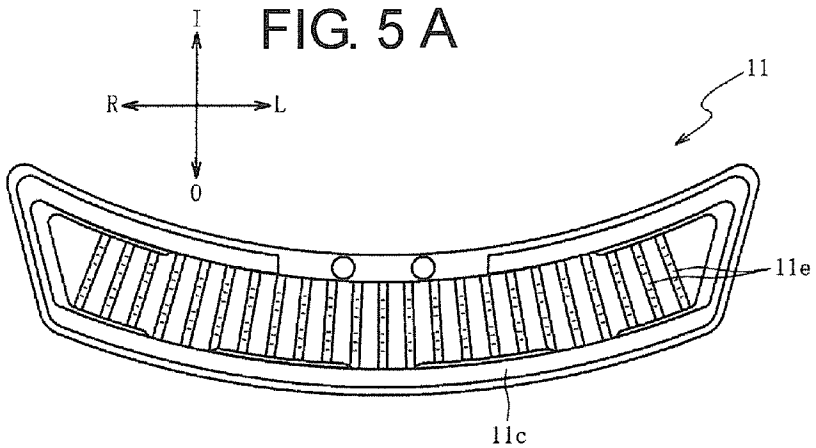
FIG. 5C is a schematic bottom view of the upper main body part without the sensor plate when viewed from the lower side.

Then, with reference to FIG. 5A to FIG. 5C, the upper main body part 11 is described in detail below. FIG. 5A is a schematic bottom view of the upper main body part 11 with a sensor plate 60 installed thereon when viewed from the lower side, i.e. a side connected with the lower main body part 12. FIG. 5B is an enlarged cross-sectional view of the upper main body part 11 along the Vb-Vb line of FIG. 5A. FIG. 5C is a schematic bottom view of the upper main body part 11 without the sensor plate 60 when viewed from the lower side. In FIG. 5A to FIG. 5C, arrows are provided to specify an orientation of the upper main body part 11 according to an orientation of the attachment 100. To be more specific, arrow U, arrow B, arrow L, and arrow R respectively indicate the upper side, lower side, left side, and right side of the attachment 100 and the upper main body part 11. In addition, arrow O and arrow I respectively indicate an outward direction and an inward direction of the radial direction of the attachment 100 and the upper main body part 11.

As shown in FIG. 5A to FIG. 5C, the upper main body part 11 includes a striking surface 11*a*, a sidewall part 11*b*, and a locking protrusion part 11*c*. The striking surface 11*a* is formed at the top side (the direction of arrow U) to serve as a part to be struck by the player with a stick, etc. The sidewall part 11*b* is connected with a periphery of the lower side (the direction of arrow B) of the striking surface 11*a*. The locking protrusion part 11*c* is connected at the lower side of the sidewall part 11*b* to be locked to a locking recess part (not shown) disposed on the lower main body part 12. Through the locking of the locking protrusion part 11*c* and the locking recess part, the upper main body part 11 and the lower main body part 12 are connected with each other.

The upper main body part 11 has a concave portion 11*d* that is formed along an inner circumference of the sidewall part 11*b*. The sensor plate 60 with the vibration sensor 61 installed thereon is fitted in the concave portion 11*d*. By fitting a periphery of the sensor plate 60 in the concave portion 11*d*, the sensor plate 60 is elastically supported by the upper main body part 11.

The upper main body part 11 has convex portions 11*e*. A plurality of the convex portions 11*e* is disposed at the lower side (the direction of arrow B) of the striking surface 11*a* and is separated from each other in a longitudinal direction. As shown in FIG. 5B, in a static time, namely, a state when the striking surface 11*a* is not struck, the convex portions 11*e* are spaced from the sensor plate 60. When the striking surface 11*a* is struck, the elastic deformation of the upper main body part 11 that is made of the elastic material causes the convex portions 11*e* to press the sensor plate 60. A sheet sensor 62 (see FIG. 6A) is disposed on a surface of the sensor plate 60, which faces the convex portions 11*e*. When the striking surface 11*a* is struck, the sheet sensor 62 detects the pressing of the convex portions 11*e*.

Figure 6A:
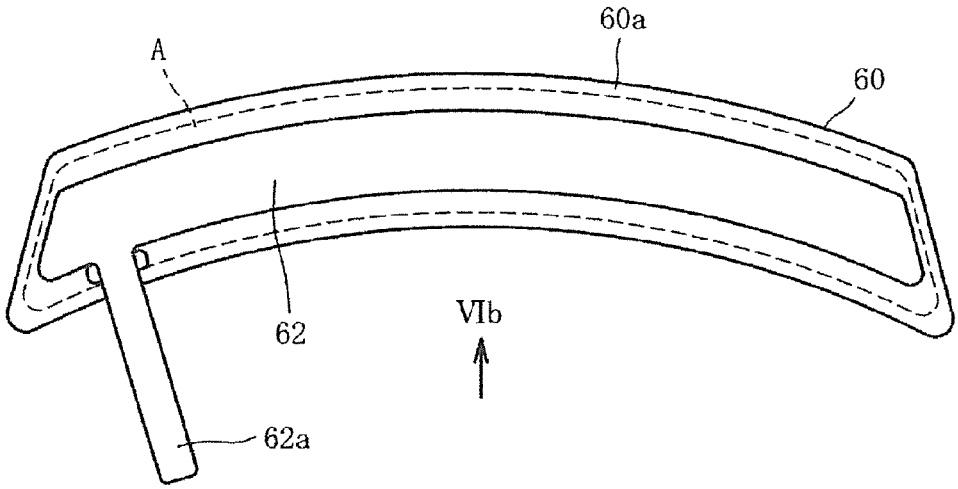
FIG. 6A is a schematic top view of a sensor plate.
Figure 6B:
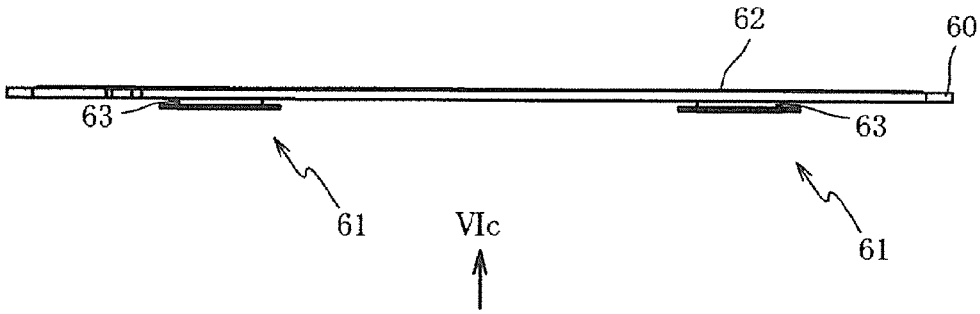
FIG. 6B is a schematic side view of the sensor plate when viewed from the VIb direction of FIG. 6A.
Figure 6C:
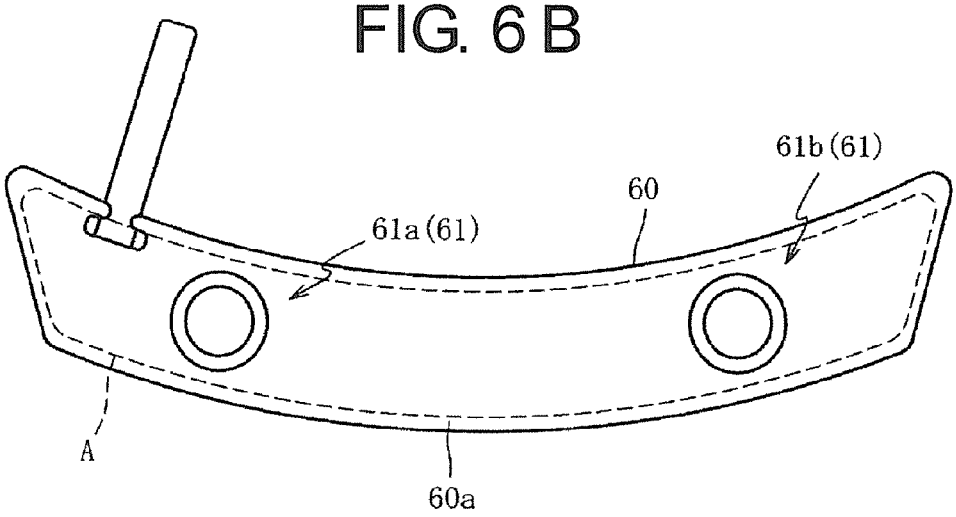
FIG. 6C is a schematic bottom view of the sensor plate when viewed from the VIc direction of FIG. 6B.

With reference to FIG. 6A to FIG. 6C, details of the sensor plate 60 are described hereinafter. FIG. 6A is a schematic top view of the sensor plate 60. FIG. 6B is a schematic side view of the sensor plate 60 when viewed from the VIb direction of FIG. 6A. FIG. 6C is a schematic bottom view of the sensor plate 60 when viewed from the VIc direction of FIG. 6B.

As shown in FIG. 6A to FIG. 6C, the sensor plate 60 is a plate that is curved in the same arc shape as the main body part 10. The sensor plate 60 is made of a metal material. As described above, the periphery of the sensor plate 60 is fitted in the concave portion 11*d* of the upper main body part 11 and elastically supported by the upper main body part 11. More specifically, an area 60*a* outside an imaginary line A, as illustrated in FIG. 6A and FIG. 6C, is fitted in the concave portion 11*d*.

The sheet sensor 62 is installed on the top surface side of the sensor plate 60. The sensor plate 60 is fitted in the concave portion 11*d* of the upper main body part 11 in a state that the surface with the sheet sensor 62 thereon faces the convex portions 11*e*. The sheet sensor 62 is a commonly known sensor that outputs a detection signal when a sheet surface thereof is pressed. As described above, in this exemplary embodiment, the sheet sensor 62 detects the pressing of the convex portions 11*e* when the striking surface 11*a* is struck. The detection signal is inputted to a circuit board (not shown) received in the lower main body part 12 via a wire 62*a*.

Two vibration sensors 61 (61*a* and 61*b*) are disposed on a bottom surface side of the sensor plate 60 via cushion tapes 63 of urethane, etc. The vibration sensor 61 is a commonly known sensor that detects the vibration of the attachment 100 and outputs a detection signal. In this exemplary embodiment, a piezoelectric vibration plate is used as the vibration sensor 61, wherein the piezoelectric vibration plate includes a piezoelectric element having electrodes formed on two surfaces of a piezoelectric ceramics, and a thin metal plate disposed on a surface of the piezoelectric element. The two vibration sensors 61*a* and 61*b* are connected in parallel by a wire not shown in the figures. Thus, an output signal of the two vibration sensors 61*a* and 61*b* is an electrical composite waveform (that is, a sum of two vibration waveforms) of the detection signals respectively outputted from the vibration sensors 61*a* and 61*b*. The output signals are inputted to the same circuit board, to which the detection signal of the sheet sensor 62 is inputted, via a wire not shown in the figures.

The circuit board, to which the detection signals of the vibration sensors 61 and the sheet sensor 62 are respectively inputted, outputs the detection signal inputted from the vibration sensors 61 to the jack 100*a* only when the detection signal of the sheet sensor 62 is inputted. Therefore, if the vibration sensors 61 detect a vibration irrelevant to the striking, e.g. a vibration of crosstalk due to striking on the head 3, output of a detection signal from the jack 100*a* and generation of a sound from the sound source device can be prevented.

Figure 7:
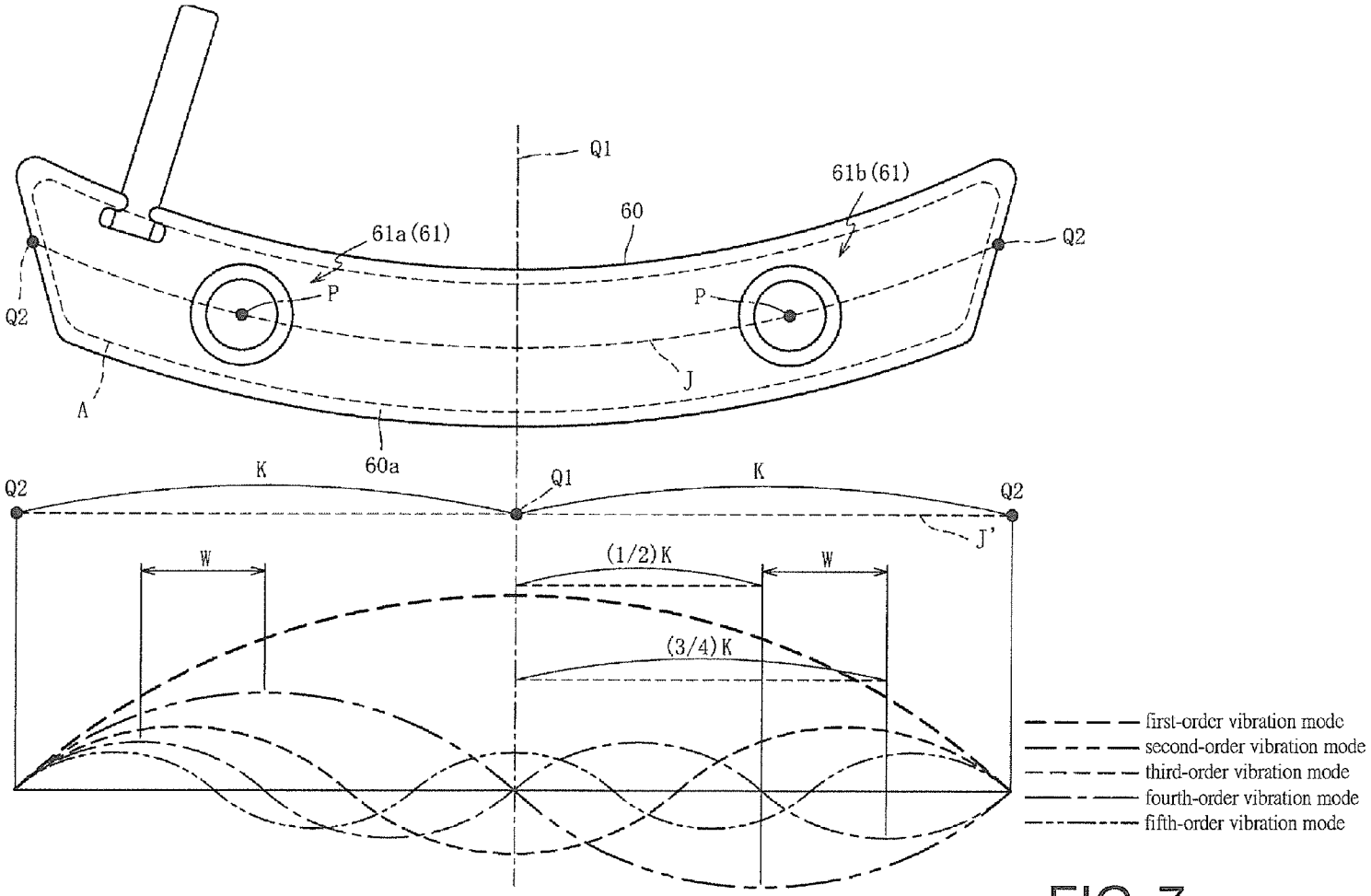
FIG. 7 is a schematic diagram illustrating an arrangement of two vibration sensors.

Next, with reference to FIG. 7, an arrangement of the two vibration sensors 61*a* and 61*b* is explained hereinafter. FIG. 7 is a schematic diagram illustrating the arrangement of the two vibration sensors 61*a* and 61*b*.

In this exemplary embodiment, the two vibration sensors 61*a* and 61*b* are disposed at symmetrical positions in the longitudinal direction with a center line Q1 as an axis of symmetry, wherein the center line Q1 extends in a transverse direction through a center of the longitudinal direction of the sensor plate 60, and the symmetrical positions are respectively within a predetermined arrangement range W. Moreover, in this exemplary embodiment, the position of the vibration sensor 61 (61*a* and 61*b*) is respectively defined by the position of a center P of the vibration sensor 61.

According to the result of the experiment carried out by the applicant, the arrangement range W, which is preferred for achieving good sensitivity distribution and stable output, is a segment of sensor plate 60 ranging between a first position and a second position, wherein the first position is (½)K away from the center line Q1 and the second position is (¾)K away from the center line Q1. In such a case, the first position at (½)K away from the center line Q1 and the second position at (¾)K away from the center line Q1 are not included in the arrangement range W. Herein, K represents a length from the center line Q1 of the sensor plate 60 to an end Q2 in the longitudinal direction.

In this exemplary embodiment, the sensor plate 60 is curved in an arc shape in the longitudinal direction, but the sensor plate can also be regarded as having an approximately rectangular shape. Accordingly, like the sensor plate 60, in the arc-shaped sensor plate that approximates to the rectangular shape, a length of a line segment J', which is obtained by stretching a center line J in the transverse direction, corresponds to the length K in the longitudinal direction.

According to the result of the experiment carried out by the applicant, no matter what position of the striking surface 11*a* is struck, a central portion of the sensor plate 60 vibrates the most. From this result, with the periphery fitted in the concave portion 11*d*, the four sides of the sensor plate 60 are semi-fixed respectively, and the sensor plate 60 vibrates in a state that the four sides are simply supported. For a plate-shaped member that vibrates in a state that the four sides thereof are simply supported, a vibration frequency in the transverse direction is very high in comparison with a vibration frequency in the longitudinal direction, and amplitude at this moment is so small that it can be ignored. Therefore, for the plate-shaped member that vibrates in the state that the four sides thereof are simply supported, it is possible to consider only the vibration in the longitudinal direction when considering the arrangement of the sensors. Thus, the first position that is (½)K away from the center line Q1 of the sensor plate 60 corresponds to an anti-node position of a second-order vibration mode, which is among the natural vibrations of the sensor plate 60 of which two ends in the longitudinal direction are simply supported. Moreover, the second position that is (¾)K away from the center line Q1 of the sensor plate 60 for corresponds to an anti-node position of a fourth-order vibration mode, which is among the natural vibrations of the sensor plate 60 of which two ends in the longitudinal direction are simply supported. In other words, the two vibration sensors 61*a* and 61*b* are preferably disposed between the anti-node positions of the second-order vibration mode and the fourth-order vibration mode and avoid the anti-node positions.

As described above, in this exemplary embodiment, the electrical composite waveform of the detection signals respectively detected by the two vibration sensors 61*a* and 61*b* is outputted as the output signal. In a case that the vibration sensors 61 (61*a* and 61*b*) are disposed in the anti-node positions of the second-order vibration mode, the detection signals of the vibration sensors 61*a* and 61*b* have opposite phases, and as a result, the detection signals may counteract each other. Likewise, in a case that the vibration sensors 61 (61*a* and 61*b*) are disposed in the anti-node positions of the fourth-order vibration mode, the detection signals of the vibration sensors 61*a* and 61*b* also have opposite phases, which causes the detection signals to counteract each other. Thus, it is preferable not to dispose the vibration sensors 61*a* and 61*b* in the anti-node positions of the second-order or the fourth-order vibration mode. In addition, in a case that the vibration sensors 61 (61*a* and 61*b*) are respectively disposed in the anti-node positions of a third-order vibration mode, which are exterior to the anti-node positions of the second-order vibration mode, when the top of the vibration sensors 61 is struck, the detection signals of the vibration sensors 61*a* and 61*b* have the same phase and therefore do not counteract each other.

Moreover, in a case that the vibration sensor 61 is disposed closer to the center line than the first position that is (½)K away from the center line Q1, the vibration of a first-order vibration mode becomes much more dominant than the vibrations of other vibration modes, as the vibration sensor 61 gets closer to the center line. For this reason, the sensitivity distribution becomes worse due to the struck position. Therefore, a boundary of the arrangement range W of the sensor plate 60 at the center side is preferably not closer to the center line than a position that is (¼)K away from the center line Q1. Nevertheless, it is possible to adopt the position that is (¼)K away from the center line Q1 as the boundary of the arrangement range W of the sensor plate 60 at the center side.

On the other hand, if the vibration sensor 61 is disposed closer to the end side than the third position that is (¾)K away from the center line Q1, the vibration is weak in every vibration mode, and therefore the detection sensitivity becomes worse. Accordingly, a boundary of the arrangement range W at the end side of the sensor plate 60 is preferably not closer to the end side than the position that is (¾)K away from the center line Q1.

Moreover, in this exemplary embodiment, a resonance vibration frequency of the vibration sensor 61 is about 6.3 kHz, and this resonance vibration frequency approximates to a natural vibration frequency (about 6.6 kHz) of the second-order vibration mode among the natural vibrations in the longitudinal direction of the sensor plate 60 of which the four sides are simply supported. By setting the arrangement range W between the first position and the second position, wherein the first position is (½)K away from the center line Q1 and the second position is (¾)K away from the center line Q1, the two vibration sensors 61*a* and 61*b* that are connected in parallel do not counteract the vibration of the second-order vibration mode of the sensor plate 60. That is to say, the vibration of the second-order vibration mode with great energy can be properly detected, and the sensitivity distribution is improved as well.

According to the result of the experiment carried out by the applicant, the arrangement range W is more preferably set to be between the first position and the third position and is set to include the third position, wherein the first position is (½)K away from the center line Q1 and the third position is (⅔)K away from the center line Q1. In such a case, the first position that is (½)K away from the center line Q1 is not included in the arrangement range W, but the third position that is (⅔)K away from the center line Q1 is included in the arrangement range W. In other words, the two vibration sensors 61*a* and 61*b* are more preferably disposed between the anti-node positions of the second-order vibration mode and the third-order vibration mode but avoid the anti-node positions of the second-order vibration mode.

As described above, in the attachment 100 of this exemplary embodiment, the two vibration sensors 61 (61*a* and 61*b*) disposed on the sensor plate 60 are connected in parallel, and the electrical composite waveform of the detection signals detected by the vibration sensors 61*a* and 61*b* is outputted to the sound source device (not shown). Therefore, the striking on the striking surface can be sensed without an addition operation, by means of software, of an absolute value of the detection signals of the sensors. Consequently, the sensing process is simplified and can be achieved with lower costs.

Moreover, in the attachment 100, the two vibration sensors 61*a* and 61*b* are disposed in the range between the first position and the second position, wherein the first position is (½)K apart from the center line Q1 in the longitudinal direction of the sensor plate 60 and the second position is (¾)K apart from the center line Q1. More preferably, the two vibration sensors 61*a* and 61*b* are disposed in the range between the first position and the third position, wherein the first position is (½)K apart from the center line Q1 in the longitudinal direction of the sensor plate 60 and the third position is (⅔)K apart from the center line Q1. By respectively disposing the two vibration sensors 61*a* and 61*b* in the aforementioned ranges and at symmetrical positions in the longitudinal direction with the center line Q1 of the sensor plate 60 as the axis of symmetry, the sensitivity distribution for sensing the striking can be uniform and the output can also be stabilized.

The above disclosure illustrates the present invention on the basis of the exemplary embodiments. However, it should be understood that the present invention is not limited to any of the exemplary embodiments, and various modifications or alterations may be made without departing from the spirit of the present invention.

For example, the aforementioned exemplary embodiments illustrate that the piezoelectric vibration plate, which includes the piezoelectric element having electrodes formed on two surfaces of the piezoelectric ceramics, and the thin metal plate disposed on the surface of the piezoelectric element, is used as the vibration sensor 61. However, the present invention is not limited thereto. The vibration sensor 61 may be any type of sensor that is capable of detecting vibration. For instance, a sensor that detects displacement or a sensor that detects acceleration can also be used as the vibration sensor 61.

In the aforementioned exemplary embodiments, the two vibration sensors 61*a* and 61*b* (center P) are disposed at symmetrical positions in the longitudinal direction with the center line Q1 of the sensor plate 60 as the axis of symmetry. However, the present invention is not limited thereto. The two vibration sensors 61*a* and 61*b* may be disposed asymmetrically to the center line Q1 as long as the detection of the vibration is not affected. However, in a case of striking an area near the center of the attachment 100, which receives striking most frequently, it is preferable to dispose the two vibration sensors 61*a* and 61*b* symmetrically to the center line Q1, so as to eliminate a time difference between the striking and the sensors' detection of the striking and increase sensing accuracy of the striking on the striking surface.

The aforementioned exemplary embodiments illustrate the situation that the main body part 10 is curved in the arc shape. However, the present invention is not limited thereto. The main body part 10 may have other shapes, e.g. a rectangular shape that is not curved.

The aforementioned exemplary embodiments illustrate the situation that the attachment 100 is installed on an electronic percussion instrument (drum 1). However, the attachment 100 may also be installed on an acoustic percussion instrument or a stand.

The aforementioned exemplary embodiments illustrate that the attachment 100 is tightened together with the flange part 4*a* of the hoop 4 by one tension bolt 5. However, the number of the tension bolts for attaching the attachment 100 to the hoop 4 is not necessarily one but may be two or more.

The aforementioned exemplary embodiments illustrate the situation that the attachment 100 is used as an electronic percussion instrument. However, the present invention is not limited thereto. The attachment 100 may also be used as a controller for reproducing or stopping a song.

The aforementioned exemplary embodiments illustrate that the sensor plate 60 is made of the metal material. However, in a case that a hard material is used, the material of the sensor plate 60 is not limited to the metal material and may be a synthetic resin material or ceramic material, etc.

The aforementioned exemplary embodiments illustrate that the entire circumference of the sensor plate 60 is fitted in and elastically supported by the concave portion 11*d*. However, instead of fitting the entire circumference in the concave portion 11*d*, a portion of each of the four sides may be fitted in the concave portion 11*d*.

The aforementioned exemplary embodiments illustrate the situation that the two vibration sensors 61*a* and 61*b* are connected in parallel. However, the two vibration sensors 61*a* and 61*b* may be connected in series. In the situation that the two vibration sensors 61*a* and 61*b* are connected in series, the electrical composite waveform of the detection signals respectively outputted from the vibration sensors 61*a* and 61*b* can still be outputted as the output signal, which is the same as the situation of parallel connection.

What is claimed is:

1. A rod-shaped percussion instrument, comprising:

a striking surface made of an elastic material in a substantially rectangular shape when viewed from above;

a sidewall part made of an elastic material and connected with a periphery of the striking surface;

a sensor plate which is plate-shaped, made of a hard material in a substantially rectangular shape and comprising long sides and short sides that are elastically supported by an inner circumference side of the sidewall part; and two sensors disposed on a surface side of the sensor plate and detecting a vibration due to striking on the striking surface, wherein the two sensors are connected to electrically combine detection signals respectively detected by the two sensors and output the same, wherein the two sensors are respectively disposed in a predetermined range located on two sides of a center line that extends in a transverse direction through a center of a longitudinal direction of the sensor plate, and wherein the predetermined range is a range between a first position and a second position, wherein the first position is away from the center line at ½ of a distance from the center line to an end side of the sensor plate in the longitudinal direction and the second position is away from the center line at ¾ of the distance from the center line to the end side of the sensor plate in the longitudinal direction.

2. The rod-shaped percussion instrument according to claim 1, wherein the predetermined range is a range between the first position that is apart from the center line of ½ of the distance from the center line to the end side of the sensor plate in the longitudinal direction, and a third position that is apart from the center line of ⅔ of the distance from the center line to the end side of the sensor plate in the longitudinal direction.

3. The rod-shaped percussion instrument according to claim 1, wherein the two sensors are disposed symmetrically with the center line of the sensor plate as an axis of symmetry.

4. The rod-shaped percussion instrument according to claim 1, further comprising a concave portion on the inner circumference side of the sidewall part to fit the long sides and the short sides of the sensor plate, wherein the sensor plate is elastically supported with the long sides and the short sides fitted in the concave portion.

5. The rod-shaped percussion instrument according to claim 1, further comprising a sheet sensor disposed on another surface side of the sensor plate, which faces a bottom surface side of the striking surface.

6. The rod-shaped percussion instrument according to claim 5, wherein a signal obtained by electrically combining the detection signals respectively detected by the two sensors is outputted only when a signal from the sheet sensor is detected.

7. The rod-shaped percussion instrument according to claim 5, further comprising a plurality of convex portions disposed on the bottom surface side of the striking surface and separated from each other in a longitudinal direction of the striking surface, wherein the plurality of convex portions are spaced from the sensor plate when the striking surface is not struck, and the plurality of convex portions press the sensor plate when the striking surface is struck.

8. The rod-shaped percussion instrument according to claim 1 is detachably installed on a drum by a tension bolt.

9. The rod-shaped percussion instrument according to claim 1, wherein the striking surface has a substantially arc shape when viewed from above.

10. The rod-shaped percussion instrument according to claim 1, wherein the two sensors are connected in parallel.

11. A rod-shaped percussion instrument, comprising:

a striking surface made of an elastic material in a substantially rectangular shape when viewed from above;

a sensor plate which is plate-shaped, made of a hard material in a substantially rectangular shape, and the sensor plate being elastically supported by a position that faces a bottom surface side of the striking surface; and two sensors disposed on a surface side of the sensor plate and detecting a vibration due to striking on the striking surface, wherein the two sensors are connected to electrically combine detection signals respectively detected by the two sensors and output the same.

12. The rod-shaped percussion instrument according to claim 11, further comprising a sidewall part made of an elastic material and connected with a periphery of the striking surface, wherein long sides and short sides of the sensor plate are elastically supported by an inner circumference side of the sidewall part.

13. The rod-shaped percussion instrument according to claim 12, further comprising a concave portion on the inner circumference side of the sidewall part to fit the long sides and the short sides of the sensor plate, wherein the sensor plate is elastically supported with the long sides and the short sides fitted in the concave portion.

14. The rod-shaped percussion instrument according to claim 11, wherein the two sensors are respectively disposed in a predetermined range located on two sides of a center line that extends in a transverse direction through a center of the sensor plate of a longitudinal direction of the sensor plate, and wherein the predetermined range is a range between a first position and a second position, wherein the first position is away from the center line at ½of a distance from the center line to an end side of the sensor plate in the longitudinal direction and the second position is away from the center line at ¾ of the distance from the center line to the end side of the sensor plate in the longitudinal direction.

15. The rod-shaped percussion instrument according to claim 11, wherein the two sensors are respectively disposed in a predetermined range located on two sides of a center line that extends in a transverse direction through a center of the sensor plate in a longitudinal direction of the sensor plate, and wherein the predetermined range is a range between a first position and a third position, wherein the first position is away from the center line at ½ of a distance from the center line to an end side of the sensor plate in the longitudinal direction and the third position is away from the center line of ⅔ of the distance from the center line to the end side of the sensor plate in the longitudinal direction.

16. The rod-shaped percussion instrument according to claim 11, wherein the two sensors are disposed symmetrically with a center line of the sensor plate as an axis of symmetry.

17. The rod-shaped percussion instrument according to claim 11, further comprising a sheet sensor disposed on another surface side of the sensor plate, which faces the bottom surface side of the striking surface.

18. The rod-shaped percussion instrument according to claim 17, wherein a signal obtained by electrically combining the detection signals respectively detected by the two sensors is outputted only when a signal from the sheet sensor is detected.

19. The rod-shaped percussion instrument according to claim 17, further comprising a plurality of convex portions disposed on the bottom surface side of the striking surface and separated from each other in a longitudinal direction of the striking surface, wherein the plurality of convex portions are spaced from sensor plate when the striking surface is not struck, and the plurality of convex portions press sensor plate when the striking surface is struck.

* * * * *